US011639809B2

(12) United States Patent
Cline et al.

(10) Patent No.: US 11,639,809 B2
(45) Date of Patent: May 2, 2023

(54) HEAT RECOVERY OR HEATING UNIT LOAD BALANCE AND ADAPTIVE CONTROL

(71) Applicant: TRANE INTERNATIONAL INC., Davidson, NC (US)

(72) Inventors: Lee R. Cline, West Salem, WI (US); Michael C. A. Schwedler, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 275 days.

(21) Appl. No.: 17/039,543

(22) Filed: Sep. 30, 2020

(65) Prior Publication Data

US 2022/0099326 A1 Mar. 31, 2022

(51) Int. Cl.

| | |
|---|---|
| ***F24F 11/67*** | (2018.01) |
| ***F25B 49/02*** | (2006.01) |
| ***F24F 11/30*** | (2018.01) |

(52) U.S. Cl.

CPC ..... *F24F 11/67* (2018.01); *F24F 11/30* (2018.01); *F25B 49/02* (2013.01)

(58) Field of Classification Search

CPC ..... F24F 11/67; F24F 11/30; F25B 49/02; F25B 29/003; F25B 2600/0251; F25B 2600/026; F25B 25/005; F25B 2339/047; F25B 2700/21161; F25B 2700/21171

See application file for complete search history.

(56) References Cited

U.S. PATENT DOCUMENTS

| | | | | |
|---|---|---|---|---|
| 9,752,803 | B2 * | 9/2017 | Matter, III | F25B 13/00 |
| 2015/0285539 | A1 * | 10/2015 | Kopko | F25B 41/39 62/324.1 |

FOREIGN PATENT DOCUMENTS

| | | | |
|---|---|---|---|
| DE | 202014103193 | U1 | 7/2015 |
| WO | 2019/012582 | A1 | 1/2019 |
| WO | 2019/073177 | A1 | 4/2019 |

OTHER PUBLICATIONS

Extended European Search Report; European Patent Application No. 21199616.0, dated Feb. 18, 2022 (7 pages).

* cited by examiner

*Primary Examiner* — Charles R Kasenge
(74) *Attorney, Agent, or Firm* — Hamre, Schumann, Mueller & Larson, P.C.

(57) ABSTRACT

Control systems and methods for control of heating, ventilation, air conditioning, and refrigeration (HVACR) systems that include cooling and one or both of heating and heat recovery can include adaptive and balanced modes for each of heating and cooling operations. The adaptive heating and cooling modes each respectively include controlling the HVACR system to achieve a target temperature for the respective heating or cooling process fluid and to unload or stop the compressor when the temperature of a the other of the cooling or heating process fluid exceeds a threshold. The balanced heating and cooling modes respectively include controlling a quantity of flow of the cooling or heating process fluids to meet balanced heating or cooling target temperatures for the respective heating or cooling process fluids and also the other of the cooling or heating process fluid.

17 Claims, 5 Drawing Sheets

HEAT RECOVERY OR HEATING UNIT LOAD BALANCE AND ADAPTIVE CONTROL

FIELD

This disclosure is directed to heating, ventilation, air conditioning, and refrigeration (HVACR) systems where heat recovery or heating is controlled, particularly to achieve both targeted cooling and heating temperatures.

BACKGROUND

Current water cooled chillers and heat pumps are used to provide cooling and heating, but are unable to simultaneously maintain leaving evaporator and condenser fluid temperatures. Currently, a unit operating in a cooling mode is able to produce its leaving evaporator (cooling) fluid temperature setpoint, but the leaving condenser water (heating) temperature varies. Alternatively, if operating in the heating mode, a unit is able to produce its leaving condenser (heating) fluid temperature setpoint, but the leaving evaporator water (cooling) temperature varies. These systems further require complex system control logic to remain within unit limits, and further require external building automation system control of auxiliaries. Current systems for simultaneously delivery of cold and hot water temperatures require a building automation system (BAS) to monitor unit temperatures, flows, and other operating limits, which adds complexity and can reduce efficiency. Further, programming of the BAS is done individually at each site, and can lead to variance in the programming by building and installer. Individual programming of the BAS can thus lead to integration issues, and consumes time and increases costs for each installation. The resultant sequence of operation is often not optimized, robust, efficient, reliable, repeatable or understandable. This can result in systems that do not work throughout the life of the building or that are not ultimately put into use.

SUMMARY

This disclosure is directed to heating, ventilation, air conditioning, and refrigeration (HVACR) systems where heat recovery or heating is controlled, particularly to achieve both targeted cooling and heating temperatures.

By incorporating such control into the HVACR system, the ability of the HVACR system to respond to multiple system demands such as simultaneous heating and cooling can be provided. Further, providing this feature at the HVACR system level improves interoperability and simplifies installation and setup of HVACR systems which will experience these multiple system demands.

In an embodiment, a heating, ventilation, air conditioning, and refrigeration (HVACR) system includes a compressor configured to compress a working fluid, a first heat exchanger configured to exchange heat between the working fluid and a first process fluid, where the first process fluid further exchanges heat with a heating load, a second heat exchanger configured to exchange heat between the working fluid and a second process fluid, where the second process fluid exchanges heat with a cooling load, a first temperature sensor configured to measure a temperature of the first process fluid and a second temperature sensor configured to measure a temperature of the second process fluid. The HVACR system further includes a controller configured to selectively operate the HVACR system in at least one mode selected from a group including one or more of an adaptive cooling mode, an adaptive heating mode, a balanced cooling mode, or a balanced heating mode. The adaptive cooling mode includes controlling the HVACR system to achieve a target temperature for the second process fluid and to unload or stop the compressor when the temperature of the first process fluid exceeds a heating safety threshold value. The adaptive heating mode includes controlling the HVACR system to achieve a target temperature for the first process fluid and to unload or stop the compressor when the temperature of the second process fluid falls below a cooling safety threshold value. In the balanced cooling mode, a quantity of flow of the first process fluid is controlled to meet balanced cooling target temperatures for the first process fluid and the second process fluid. In the balanced heating mode, a quantity of flow of the second process fluid is controlled to meet balanced heating target temperatures for the first process fluid and the second process fluid.

In an embodiment, the group includes the adaptive cooling mode, the adaptive heating mode, the balanced cooling mode, and the balanced heating mode.

In an embodiment, the HVACR system further includes a third heat exchanger configured to exchange heat between the working fluid and a third process fluid, where the third process fluid further exchanges heat with an ambient environment. In an embodiment, the HVACR system further includes a pump configured to provide a variable flow of the third process fluid, wherein the balanced cooling mode further comprises modulating the variable flow of the third process fluid using the pump.

In an embodiment, the first temperature sensor measures the temperature of the first process fluid where the first process fluid leaves the first heat exchanger and the second temperature sensor measures the temperature of the second process fluid where the second process fluid leaves the second heat exchanger.

In an embodiment, the HVACR system further includes at least one of a pump, a control valve, and a diverting mixing valve included in a fluid circuit for the first process fluid, and wherein the controller is configured to modulate at least one of the pump, the control valve, and the diverting mixing valve when in the balanced cooling mode. In an embodiment, the HVACR system further includes at least one of a pump, a control valve, and a diverting mixing valve included in a fluid circuit for the second process fluid, and wherein the controller is configured to modulate at least one of the pump, the control valve, and the diverting mixing valve when in the balanced heating mode.

In an embodiment, a control system for a heating, ventilation, air conditioning, and refrigeration (HVACR) system includes a controller configured to selectively operate the HVACR system in at least one mode selected from a group including one or more of an adaptive cooling mode, an adaptive heating mode, a balanced cooling mode, or a balanced heating mode. The adaptive cooling mode that includes controlling the HVACR system to achieve a target temperature for the second process fluid and to unload or stop the compressor when the temperature of the first process fluid exceeds a heating safety threshold value. The adaptive heating mode includes controlling the HVACR system to achieve a target temperature for the first process fluid and to unload or stop the compressor when the temperature of the second process fluid falls below a cooling safety threshold value. In the balanced cooling mode, a quantity of flow of the first process fluid is controlled to meet balanced cooling target temperatures for the first process fluid and the second process fluid. In the balanced heating mode, a quantity of flow of the second process fluid is controlled to meet balanced heating target temperatures for the first process fluid and the second process fluid.

In an embodiment, the group includes the adaptive cooling mode, the adaptive heating mode, the balanced cooling mode, and the balanced heating mode.

In an embodiment, the controller is further configured to control a pump, the pump configured to provide a variable flow of a source process fluid, and at least one of the balanced cooling mode and the balanced heating mode further comprise directing the pump to modulate the variable flow of the source process fluid.

In an embodiment, the controller is connected to at least one of a pump, a control valve, and a diverting mixing valve included in a circuit for the heating process fluid, and is configured to modulate at least one of the pump, the control valve, and the diverting mixing valve when in the balanced cooling mode. In an embodiment, the controller is connected to at least one of a pump, a control valve, and a diverting mixing valve included in a circuit for the cooling process fluid, and is configured to modulate at least one of the pump, the control valve, and the diverting mixing valve when in the balanced heating mode.

In an embodiment, a method of controlling a heating, ventilation, air conditioning, and refrigeration (HVACR) system includes selecting an operating mode from a group including at least one of an adaptive cooling mode, an adaptive heating mode, a balanced cooling mode, and a balanced heating mode and operating the HVACR system according to the operating mode. The adaptive cooling mode includes controlling the HVACR system to achieve a target temperature for a cooling process fluid and unloading or stopping a compressor when the temperature of a heating process fluid exceeds a heating safety threshold value. The adaptive heating mode includes controlling the HVACR system to achieve a target temperature for the heating process fluid and unloading or stopping the compressor when the temperature of the cooling process fluid falls below a cooling safety threshold value. The balanced cooling mode includes controlling a quantity of flow of the heating process fluid to meet balanced cooling target temperatures for the heating process fluid and the cooling process fluid. The balanced heating mode includes controlling a quantity of flow of the cooling process fluid to meet balanced heating target temperatures for the heating process fluid and the cooling process fluid.

In an embodiment, selecting the operating mode includes determining whether to prioritize cooling or heating based on cooling and heating demands, selecting one of the adaptive cooling mode or the balanced cooling mode when cooling is prioritized, and selecting one of the adaptive heating mode or the balanced heating mode when heating is prioritized.

In an embodiment, operating the HVACR system in at least one of the balanced cooling mode or the balanced heating mode includes controlling an amount of a variable flow of a source fluid separate from the cooling process fluid and the heating process fluid.

In an embodiment, operating the HVACR system in the balanced heating mode includes modulating at least one of a pump, a control valve, and a diverting mixing valve included in a cooling process fluid circuit. In an embodiment, operating the HVACR system in the balanced cooling mode includes modulating at least one of a pump, a control valve, and a diverting mixing valve included in a heating process fluid circuit.

In an embodiment, operating the HVACR system in the balanced cooling mode further includes unloading or stopping a compressor when the temperature of a heating process fluid exceeds a heating safety threshold value. In an embodiment, operating the HVACR system in the balanced heating mode further includes unloading or stopping the compressor when the temperature of the cooling process fluid falls below a cooling safety threshold value.

DRAWINGS

DETAILED DESCRIPTION

This disclosure is directed to heating, ventilation, air conditioning, and refrigeration (HVACR) systems where heat recovery or heating is controlled, particularly to achieve both targeted cooling and heating temperatures.

Figure 1:
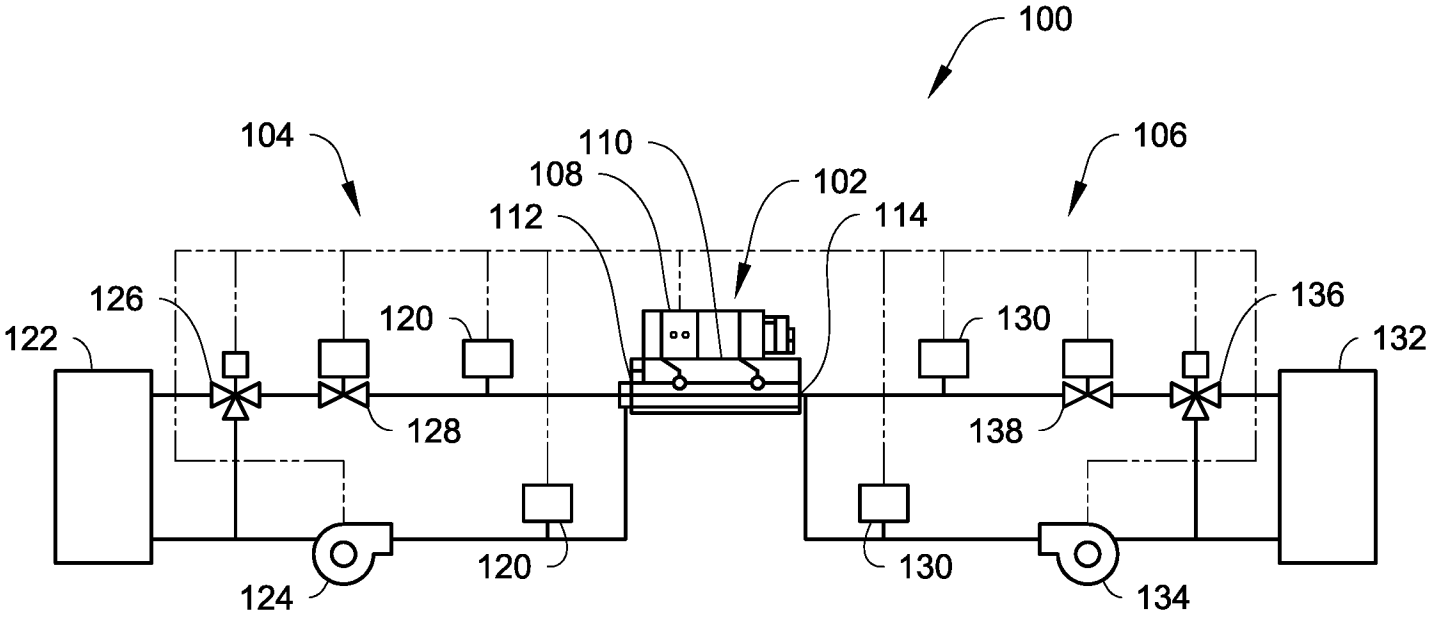
FIG. 1 shows a heating, ventilation, air conditioning, and refrigeration (HVACR) system according to an embodiment.

FIG. 1 shows a heating, ventilation, air conditioning, and refrigeration (HVACR) system according to an embodiment. HVACR system 100 includes a working fluid circuit 102, a heating process fluid circuit 104, and a cooling process fluid circuit 106. The HVACR system 100 also includes a controller 108.

Working fluid circuit 102 includes a compressor 110, condenser 112, an expansion device (not shown), and evaporator 114. The working fluid circuit is configured to operate as a refrigeration circuit, compressing the working fluid at compressor 110, rejecting heat from the working fluid to condense it at condenser 112, expanding the working fluid using any suitable expander such as expansion valves, orifices, or the like, with the working fluid then absorbing heat at evaporator 114. The working fluid used in working fluid circuit 102 can be any suitable refrigerant that can be used in a vapor compression refrigeration circuit.

Compressor 110 is configured to compress a working fluid. The compressor 110 can be any suitable compressor for compressing the working fluid, such as, as non-limiting examples, a screw compressor, centrifugal compressor or scroll compressor. In an embodiment, compressor 110 is a variable capacity compressor, for example having a variable speed control and/or one or more mechanical unloaders capable of varying the capacity of the compressor. The mechanical unloaders can be any suitable unloader for a compressor, such as, for example, slide valves or pistons, inlet guide vanes, ports, or any other unloader suitable for use with the compressor of the HVACR system. Compressor 110 can be controlled by controller 108, for example, to shut off when controller 108 issues a command, or capable of varying its capacity in response to a command from controller 108.

Condenser 112 is a heat exchanger configured to exchange heat between the working fluid and the heating process fluid of the heating process fluid circuit 104. Condenser 112 can be any suitable heat exchanger configured to receive the working fluid and the heating process fluid and allow for the exchange of heat between the fluids without allowing them to mix. In an embodiment, the working fluid rejects heat to the heating process fluid at condenser 112, raising the temperature of the heating process fluid.

Evaporator 114 is another heat exchanger, configured to exchange heat between the working fluid and the cooling process fluid of the cooling process fluid circuit 106. Evaporator 114 can be any suitable heat exchanger configured to receive the working fluid and the cooling process fluid and allow for the exchange of heat between the fluids without allowing them to mix. In an embodiment, the working fluid absorbs heat from the cooling process fluid at evaporator 114, lowering the temperature of the cooling process fluid.

Heating process fluid circuit 104 can include condenser 112, temperature sensor 120, heating load 122 and at least one of pump 124, diverting mixing valve 126, and control valve 128. Optionally, the heating process fluid circuit 104 can include additional components, including non-limiting examples such as differential pressure sensors, flow meters, and the like. Heating process fluid circuit 104 circulates a heating process fluid. The heating process fluid can be any suitable fluid, such as, as non-limiting examples, water, water including an anti-freezing additive such as glycol, and the like.

At condenser 112, the heating process fluid is heated by the heat rejected from the working fluid. The heating process fluid exchanges heat with a heating load 122. The heating load 122 can be any one or more devices configured to make use of heat rejected from the heating process fluid, such as one or more water heaters, dehumidifiers, heaters, or any other such suitable device. After rejecting heat at the heating load 122, heating process fluid circuit 104 circulates the heating process fluid back to condenser 112 to absorb heat rejected by the working fluid.

Temperature sensor 120 can be included along heating process fluid circuit 104 and configured to measure the temperature of the heating process fluid at that point in the heating process fluid circuit 104. Temperature sensor 120 can be operatively connected to controller 108 such that it can provide the measured temperature to controller 108, for example through wired or wireless communications, which can be direct communications or include additional devices or controls such as, as a non-limiting example, a building automation system (BAS). Temperature sensor 120 can be any suitable temperature sensor for measuring the temperature of the heating process fluid. In an embodiment, temperature sensor 120 is included immediately upstream or immediately downstream from condenser 112. In an embodiment, multiple temperature sensors 120 are included in heating process fluid circuit 104. In an embodiment, the multiple temperature sensors 120 include one located immediately upstream from condenser 112 and another located immediately downstream from condenser 112.

In an embodiment, heating process fluid circuit 104 includes pump 124. Pump 124 can be any suitable pump configured to drive the flow of the heating process fluid through the heating process fluid circuit 104. In an embodiment, pump 124 is a controllable pump having a variable output, such as a variable-speed pump. In an embodiment, pump 124 is controlled by a variable speed drive. In an embodiment, the pump 124 is controlled based on commands from controller 108, for example to provide a desired flow rate through the heating process fluid circuit 104.

In an embodiment, heating process fluid circuit 104 includes diverting mixing valve 126. Diverting mixing valve 126 can be a valve configured to allow a selected quantity of the heating process fluid to bypass the condenser 112. The diverting mixing valve 126 can be used to control an amount of heating process fluid that absorbs heat at condenser 112. The diverting mixing valve 126 can be controlled by controller 108 to control the amount of heating process fluid that bypasses the condenser 112, for example based on a target amount determined by the controller 108. In an embodiment, the pump 124 can be positioned such that it is between the line connected to diverting mixing valve 126 bypassing condenser 112 and the heating load 122, such that fluid diverted by the diverting mixing valve 126 is included in the flow that is driven by the pump 124.

In an embodiment, heating process fluid circuit 104 includes control valve 128. Control valve 128 is a controllable valve configured to control the flow rate through heating process fluid circuit 104. Control valve 128 can be any suitable valve for controlling flow of the heating process fluid, such as, as a non-limiting example, a variable-size orifice. The control valve 128 can be controlled based on commands from controller 108 of the HVACR system 100, for example to permit a desired amount of flow or a desired flow rate through the heating process fluid circuit 104. The controller 108 can be configured to receive input from other controls, such as, for example, the BAS.

Cooling process fluid circuit 106 includes evaporator 114, temperature sensor 130 and cooling load 132. Cooling process fluid circuit 106 can further include one or more of pump 134, diverting mixing valve 136, and control valve 138. Cooling process fluid rejects heat to the working fluid at evaporator 114, lowering the temperature of the cooling process fluid. The cooling process fluid then circulates through cooling process fluid circuit 106 to the cooling load 132. The cooling load 132 can be any one or more devices where the cooling process fluid absorbs heat, such as one or more terminal units for cooling in a building HVACR system or any other such suitable devices. In an embodiment, the cooling process fluid includes water. In an embodiment, the cooling process fluid further includes one or more additives, for example to lower a freezing point of the cooling process fluid.

Temperature sensor 130 can be included along cooling process fluid circuit 106 and configured to measure the temperature of the cooling process fluid at that point in the cooling process fluid circuit 106. Temperature sensor 130 can be operatively connected to controller 108 such that it can provide the measured temperature to controller 108, for example through wired or wireless communications. The communications can optionally include other devices, such as, as a non-limiting example, the BAS. Temperature sensor 130 can be any suitable temperature sensor for measuring the temperature of the cooling process fluid. In an embodiment, temperature sensor 130 is included immediately upstream or immediately downstream from evaporator 114. In an embodiment, multiple temperature sensors 130 are included in cooling process fluid circuit 106. In an embodiment, the multiple temperature sensors 130 include one located immediately upstream from evaporator 114 and another located immediately downstream from evaporator 114.

In an embodiment, cooling process fluid circuit 106 includes pump 134. Pump 134 can be any suitable pump configured to drive the flow of the cooling process fluid through the cooling process fluid circuit 106. In an embodiment, pump 134 is a controllable pump having a variable output, such as a variable-speed pump. In an embodiment, pump 134 is controlled by a variable speed drive. In an embodiment, the pump 134 is controlled based on commands from controller 108, for example to provide a desired flow rate through the cooling process fluid circuit 106.

In an embodiment, cooling process fluid circuit 106 includes diverting mixing valve 136. Diverting mixing valve 136 can be a valve configured to allow a selected quantity of the cooling process fluid to bypass the evaporator 114. The diverting mixing valve 136 can be used to control an amount of cooling process fluid that rejects heat at evaporator 114. The diverting mixing valve 136 can be controlled by controller 108 to control the amount of cooling process fluid that bypasses the evaporator 114, for example based on a target amount determined by the controller 108. In an embodiment, the pump 134 can be located between a fluid line connected to the diverting mixing valve 136 that bypasses the evaporator 114 and heating load 132, such that fluid passing through this fluid line bypassing the evaporator is included in the flow driven by pump 134.

In an embodiment, cooling process fluid circuit 106 includes control valve 138. Control valve 138 is a controllable valve configured to control the flow rate through cooling process fluid circuit 106. Control valve 138 can be any suitable valve for controlling flow of the cooling process fluid, such as, as a non-limiting example, a variable-size orifice. The control valve 138 can be controlled based on commands from controller 108, for example to permit a desired amount of flow or a desired flow rate through the cooling process fluid circuit 106.

In an embodiment, heating process fluid circuit 104 and cooling process fluid circuit 106 include the same devices selected from the pumps 124, 134, the diverting mixing valves 126, 136, and the control valves 128, 138. In an embodiment, the heating process fluid circuit 104 and the cooling process fluid circuit 106 include at least some differences in which of those devices are included in each respective circuit. Controller 108 may control any or all such devices included in their respective fluid circuits. In embodiments, pumps 124 and/or 134 may be constant-output pumps not controlled by controller 108.

Controller 108 is a controller configured to control one or more of the operation of compressor 110 and/or flow through one or both of the heating process fluid circuit 104 and the cooling process fluid circuit 106, for example by controlling one or more of pumps 124 and 134, diverting mixing valves 126 and 136, or control valves 128 and 138. Controller 108 can include one or more processors. Controller 108 can be connected to temperature sensors 120 and 130 to receive temperature readings for the heating process fluid circuit 104 from temperature sensors 120 and temperature readings for the cooling process fluid circuit 106.

Controller 108 can be configured to operate the HVACR system 100 in a mode of operation selected from one or more of an adaptive cooling mode, an adaptive heating mode, a balanced cooling mode, and a balanced heating mode. The adaptive cooling mode includes controller 108 controlling the HVACR system to achieve a target temperature for the cooling process fluid and the controller 108 directing the unloading or stopping of compressor 110 when the temperature of the heating process fluid goes above a heating safety threshold value. The adaptive heating mode includes controller 108 controlling the HVACR system to achieve a target temperature for the heating process fluid and the controller 108 directing the unloading or stopping of compressor 110 when the temperature of the cooling process fluid falls below a cooling safety threshold value. The balanced cooling mode includes the controller 108 determining a quantity of flow of the heating process fluid to meet balanced cooling target temperatures for the heating process fluid and the cooling process fluid. In an embodiment, operating the HVACR system in the balanced cooling mode further includes unloading or stopping a compressor when the temperature of a heating process fluid exceeds a heating safety threshold value. The balanced heating mode includes the controller 108 determining a quantity of flow of the cooling process fluid to meet balanced heating target temperatures for the heating process fluid and the cooling process fluid. In an embodiment, operating the HVACR system in the balanced heating mode further includes unloading or stopping the compressor when the temperature of the cooling process fluid falls below a cooling safety threshold value.

In embodiments, the controller 108 can further be configured to determine the mode of operation for the HVACR system 100. In an embodiment, the determination of the mode of operation can include determining whether to operate in a heating or cooling mode based on demand for each of heating and cooling from the HVACR system 100. In an embodiment, the selection of the adaptive or balanced mode of either heating or cooling can also be based on the demand for heating and/or cooling and the ability to meet those demands in either the adaptive or balanced mode for heating or cooling.

Figure 2:
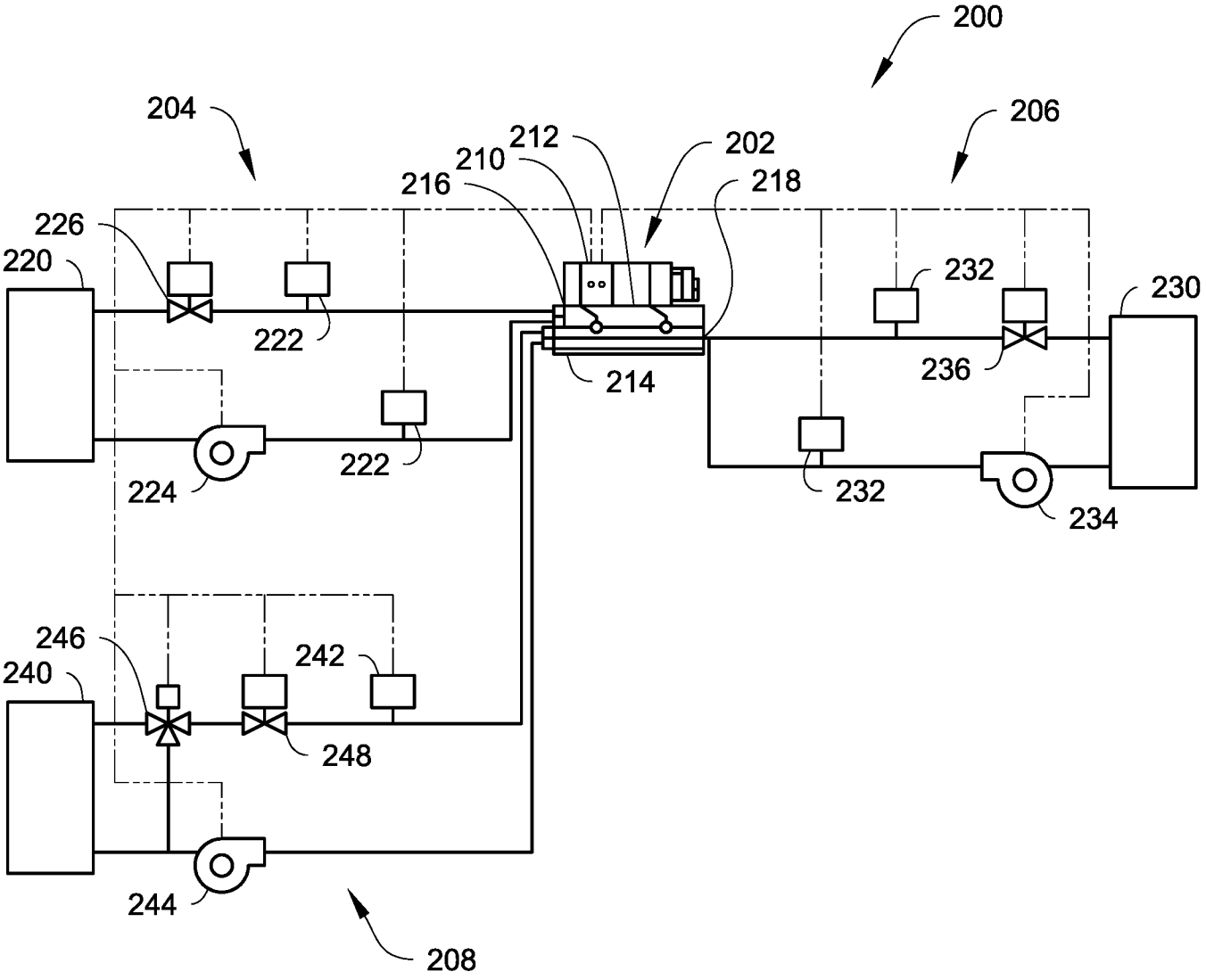
FIG. 2 shows an HVACR system according to an embodiment.

FIG. 2 shows an HVACR system according to an embodiment. HVACR system 200 includes working fluid circuit 202, heating process fluid circuit 204, a cooling process fluid 206 and a source fluid circuit 208. HVACR system 200 further includes a controller 210.

Working fluid circuit 202 includes a compressor 212, a condenser 214, a heat recovery heat exchanger 216, an expansion device (not shown) and an evaporator 218. In working fluid circuit 202, a working fluid is compressed at compressor 212, rejects heat to the source fluid at condenser 214, and rejects heat to the heating process fluid at heat recovery heat exchanger 216. Condenser 214 and heat recovery heat exchanger 216 are each heat exchangers that allow for the exchange of heat between the working fluid and the source fluid or the heating process fluid while keeping the respective fluids separate. After rejecting heat at condenser 214 and heat recovery heat exchanger 216, the working fluid can be expanded and then pass to evaporator 218, where the working fluid absorbs heat from the cooling process fluid. The working fluid can be any suitable working fluid for use in the working fluid circuit 202, for example any suitable working fluid such as a refrigerant.

Heating process fluid circuit 204 circulates a heating process fluid between heat recovery heat exchanger 216 and heating load 220. Heating process fluid circuit 204 also includes at least one or more of a temperature sensor 222, a pump 224, and a control valve 226. The heating process fluid can be any suitable fluid (i.e. liquid or gas), such as, as a non-limiting example, water.

Temperature sensor 222 is a temperature sensor configured to measure a temperature of the heating process fluid. In an embodiment, multiple temperature sensors 222 can be included in the heating process fluid circuit 204. In an embodiment, a temperature sensor 222 can be located at or near an inlet of heat recovery heat exchanger 216. In an embodiment, a temperature sensor 222 can be located at or near an outlet of heat recovery heat exchanger 216.

Pump 224 can be any suitable pump for circulating the heating process fluid through the heating process fluid circuit 204. In an embodiment, pump 224 has a controllable output. In an embodiment, pump 224 is controlled by a variable speed drive. In an embodiment, the output of pump 224 is controlled according to a command from controller 210, such as a specific flow rate or to increase or decrease a flow rate through pump 224.

Control valve 226 is a controllable valve configured to control the flow rate through heating process fluid circuit 204. Control valve 226 can be any suitable valve for controlling flow of the heating process fluid, such as, as a non-limiting example, a variable-size orifice. The control valve 226 can be controlled based on commands from controller 210, for example to permit a desired amount of flow or a desired flow rate through the heating process fluid circuit 204.

While a diverting mixing valve is not shown for the heating process fluid circuit 204 shown in FIG. 2, a diverting mixing valve such as the diverting mixing valve 126 shown in FIG. 1 can optionally be included in heating process fluid circuit 204.

Cooling process fluid circuit 206 circulates a heating cooling fluid between evaporator 218 and cooling load 230. Cooling process fluid circuit 204 also includes at least one or more of a temperature sensor 232, a pump 234, and a control valve 236. The cooling process fluid can be any suitable fluid (i.e. liquid or gas), such as, as a non-limiting example, water, optionally further including additives such as anti-freezing additives.

Temperature sensor 232 is a temperature sensor configured to measure a temperature of the cooling process fluid. In an embodiment, multiple temperature sensors 232 can be included in the cooling process fluid circuit 206. In an embodiment, a temperature sensor 232 can be located at or near an inlet of evaporator 218. In an embodiment, a temperature sensor 232 can be located at or near an outlet of evaporator 218.

Pump 234 can be any suitable pump for circulating the cooling process fluid through the cooling process fluid circuit 206. In an embodiment, pump 234 has a controllable output. In an embodiment, pump 234 is controlled by a variable speed drive. In an embodiment, the output of pump 234 is controlled according to a command from controller 210, such as a specific flow rate or to increase or decrease a flow rate through pump 234.

Control valve 236 is a controllable valve configured to control the flow rate through cooling process fluid circuit 206. Control valve 236 can be any suitable valve for controlling flow of the cooling process fluid, such as, as a non-limiting example, a variable-size orifice. The control valve 236 can be controlled based on commands from controller 210, for example to permit a desired amount of flow or a desired flow rate through the cooling process fluid circuit 206.

While a diverting mixing valve is not shown for the cooling process fluid circuit 206 shown in FIG. 2, a diverting mixing valve such as the diverting mixing valve 136 shown in FIG. 1 can optionally be included in cooling process fluid circuit 206.

Source fluid circuit 208 is a circuit configured to circulate a source fluid between condenser 214 and a source heat exchanger 240. The source heat exchanger 240 allows the exchange of heat between the source fluid and a source. The source fluid can reject heat to the source at source heat exchanger 240. The source can be, as non-limiting examples, an ambient environment, a body of water such as an ocean, lake, aquifer, or the like, a geothermal borefield, etc. In an embodiment, the source is at a temperature not significantly impacted by exchange of heat with the source fluid. The source fluid circuit 208 can include, for example, condenser 214, heating or cooling source 240, temperature sensor 242, pump 244, diverting mixing valve 246, and control valve 248. The source fluid can be any suitable fluid for exchanging heat at condenser 214 and source heat exchanger 240 such as, as a non-limiting example, water, optionally further including additives such as anti-freezing additives.

Temperature sensor 232 is a temperature sensor configured to measure a temperature of the cooling process fluid. In an embodiment, multiple temperature sensors 232 can be included in the cooling process fluid circuit 206. In an embodiment, a temperature sensor 232 can be located at or near an inlet of evaporator 218.

Figure 3:
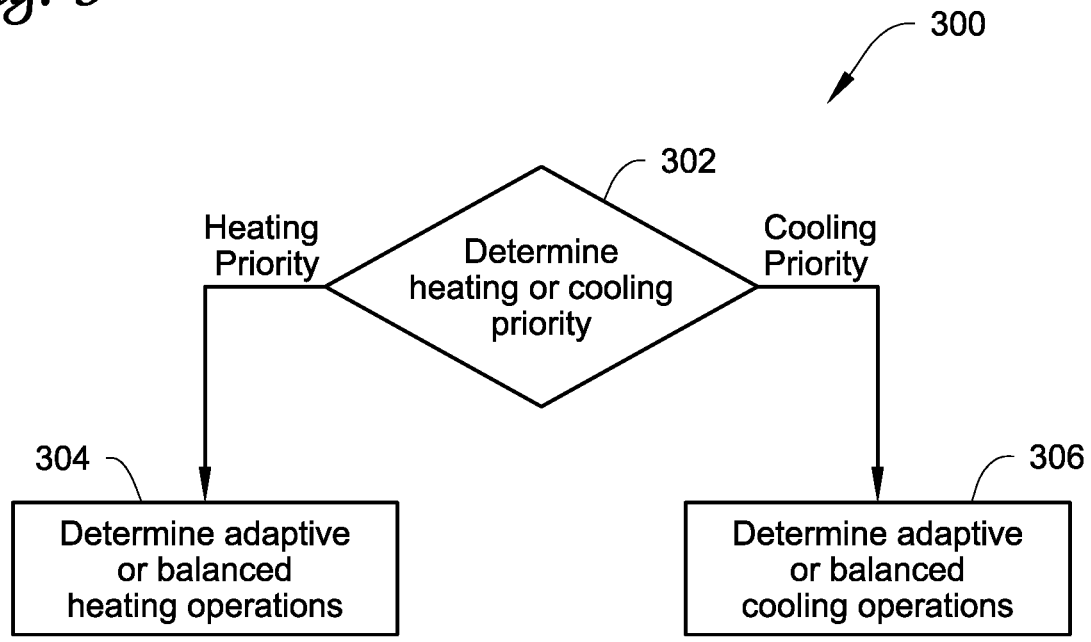
FIG. 3 shows a flowchart of a method for selecting an operating mode according to an embodiment.

FIG. 3 shows a flowchart of a method for selecting an operating mode according to an embodiment. In the embodiment shown in FIG. 3, it is determined whether to operate in a heating priority mode or a cooling priority mode 302. When it is determined to operate in a cooling priority mode, it can be determined whether to operate in an adaptive cooling mode or a balanced cooling mode at 306. When it is determined to operate in a heating priority mode, it can be determined whether to operate in an adaptive heating mode or a balanced heating mode at 304.

Operation in either a heating or cooling priority mode can be determined at 302. The determination of a heating or cooling priority mode can be based on operating conditions for the HVACR system, such as respective heating and cooling loads, set points for heating and cooling process fluids and/or deviations therefrom, or alternatively from commands from other systems such as a BAS.

In an embodiment, operation in either the heating or cooling priority mode determined at 302 can be based on switching between the heating priority and cooling priority mode based on which of a heating process fluid and a cooling process fluid is past a threshold. The threshold can be based on deviations from the set points that are indicative of heating or cooling loads being the dominant loads on the HVACR system. For example, the HVACR system can switch to the heating priority mode when a cooling process fluid temperature falls below a set point by more than a threshold value, or the cooling priority mode can be switched to when a heating process fluid is above a set point by more than a threshold value. In an embodiment, the threshold value is a value selected for being indicative of excess heating of the heating process fluid.

In an embodiment, the operating mode being a heating priority or a cooling priority operating mode can be dictated by another connected system such as a BAS. In an embodiment, the connected system such as the BAS dictates a particular operating mode such as the adaptive cooling mode, balanced cooling mode, adaptive heating mode, or balanced heating mode. In an embodiment, the connected system such as the BAS dictates that the HVACR system be in a heating mode or a cooling mode, with the selection of the adaptive or balanced of the heating mode or the cooling mode determined as discussed below in step 304 or 306.

When it is determined to operate in a cooling priority mode, it can be determined whether to operate in an adaptive cooling mode or a balanced cooling mode at 306. In an embodiment, the balanced or adaptive cooling mode can be selected based on the available controls and/or the respective heating and cooling modes. The adaptive cooling mode can be selected when there are not flow controls for heating or cooling process fluid circuits such as variable-output pumps, control valves and/or diverting mixing valves. The adaptive mode can also be selected when the heating and/or cooling loads both may not be satisfied by a combination of controlled flows through the heating and cooling process fluid circuits. The balanced mode can be an option that can be selected when one or more of the cooling process fluid circuit, heating process fluid circuit, or a source fluid circuit include one or more flow controls such as variable-output pumps, control valves, or diverting mixing valves. The balanced cooling mode can be selected when the heating and cooling loads can be met simultaneously by control of flow using one or more of the flow controls. An example of operation in the adaptive cooling mode is described below and shown in FIG. 4. An example of operation in the balanced cooling mode is described below and shown in FIG. 5.

When it is determined to operate in a heating priority mode, it can be determined whether to operate in an adaptive heating mode or a balanced heating mode at 304. In an embodiment, the balanced or adaptive heating mode can be selected based on the available controls and/or the respective heating and cooling modes. The adaptive heating mode can be selected when there are not flow controls for heating or cooling process fluid circuits such as variable-output pumps, control valves and/or diverting mixing valves. The adaptive heating mode can also be selected when the heating and/or cooling loads both may not be satisfied by a combination of controlled flows through the heating and cooling process fluid circuits. The balanced heating mode can be an option that can be selected when one or more of the cooling process fluid circuit, heating process fluid circuit, or a source fluid circuit include one or more flow controls such as variable-output pumps, control valves, or diverting mixing valves. The balanced heating mode can be selected when the heating and cooling loads can be met simultaneously by control of flow using one or more of the flow controls. An example of operation in the adaptive heating mode is described below and shown in FIG. 6. An example of operation in the balanced heating mode is described below and shown in FIG. 7.

Figure 4:
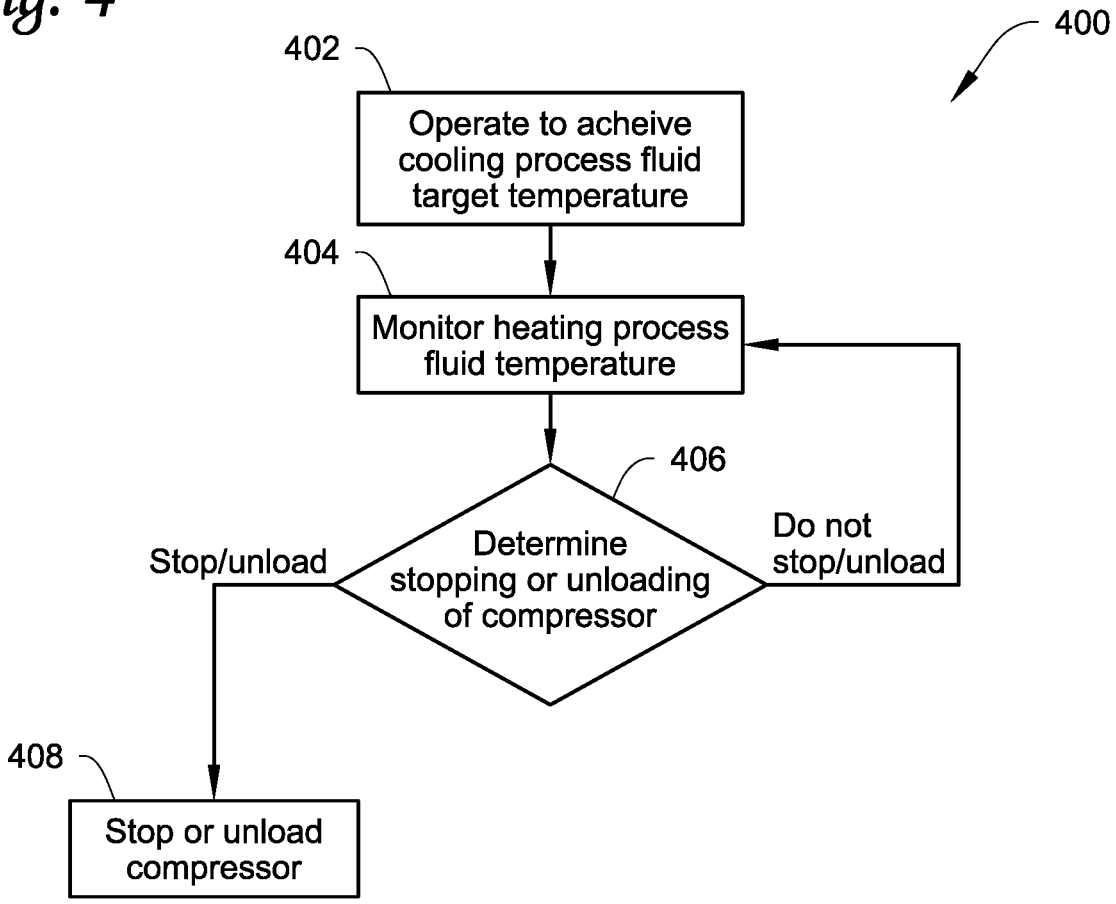
FIG. 4 shows a flowchart of a method for operating an HVACR system in an adaptive cooling mode according to an embodiment.

FIG. 4 shows a flowchart of a method for operating an HVACR system in an adaptive cooling mode according to an embodiment. Adaptive cooling mode 400 includes controlling a temperature of the cooling process fluid to achieve a target temperature 402, monitoring a heating process fluid temperature 404, determining whether to stop or unload the compressor 406, and stopping or unloading the compressor 408.

The temperature of the cooling process fluid is controlled to achieve a target temperature at 402. The temperature of the cooling process fluid can be controlled by controlling the operation of a working fluid circuit used to cool the cooling process fluid, for example by controlling the operation of a compressor included in the working fluid circuit in a manner that will bring the cooling process fluid temperature towards the target temperature. For example, the capacity of the compressor can be increased when the working fluid is above the target temperature. The target temperature can be a set point for the cooling process fluid. The target temperature can be based on where the temperature of the cooling set point is measured by a temperature sensor, for example to control according to a desired temperature for the cooling process fluid at or near an inlet or an outlet of an evaporator of the working fluid circuit where the working fluid absorbs heat from the cooling process fluid.

The temperature of the heating process fluid is monitored at 404. The temperature can be monitored using one or more temperature sensors measuring the temperature of the heating process fluid within the heating process fluid circuit. In an embodiment, the temperature of the heating process fluid is not actively controlled during adaptive cooling mode 400. In an embodiment of the adaptive cooling mode 400, the temperature of the heating process fluid can vary with the amount of heat being rejected to the heating process fluid at a condenser or heat recovery heat exchanger of the working fluid circuit. The temperature sensor used to monitor the temperature of the heating process fluid at 404 can be located anywhere along the heating process fluid circuit. In an embodiment, multiple temperature sensors can be used to monitor the temperature of the heating process fluid at 404. In an embodiment, one or more temperature sensors used to monitor the temperature of the heating process fluid 404 can be located at or near an inlet or an outlet of a heat exchanger where the heating process fluid exchanges heat with the working fluid, such as a condenser or a heat recovery heat exchanger.

It is determined whether to stop or unload the compressor at 406. The determination can be made based on the temperature of the heating process fluid monitored at 404. In an embodiment, the temperature of the heating process fluid monitored at 404 is compared to a threshold value to determine whether to stop or unload the compressor at 406. The threshold value can be a predetermined value, for example based on the operating range of the HVAC system, such as a maximum allowed temperature for the heating process fluid. In an embodiment, the determination of whether to stop or unload the compressor at 406 can be based on parameters indicative of load or capacity. As a non-limiting example, flow rates for each fluid and a desired temperature differential between process fluids can be used to determine whether to stop or unload the compressor at 406. When it is determined that the compressor does not need to be stopped or unloaded at 406, for example by the temperature remaining below the threshold, the adaptive cooling mode can continue by iterating until the threshold value is exceeded or the operating mode is changed, for example by continuing the controlling of a temperature of the cooling process fluid to achieve a target temperature at 402. When it is determined that the compressor is to be stopped or unloaded at 406, for example when the temperature of the heating process fluid monitored at 404 exceeds the threshold value, the compressor can be stopped or unloaded at 408. The stopping or unloading of the compressor at 408 can be based on the current state of the compressor and/or the temperature of the heating process fluid over time. The stopping or unloading of the compressor at 408 can, in one non-limiting example, include incremental unloading of the compressor, with the compressor being stopped if the heating process fluid temperature remains too high following complete unloading of the compressor. In an embodiment, the stopping or unloading of the compressor at 408 can include stopping the compressor or selecting a level of unloading for the compressor based on a duration of time over which the heating process fluid temperature has been elevated or the extent to which the heating process fluid temperature is elevated, for example compared to the threshold value. When unloaded at 408, the compressor may have its capacity increased again subsequently, when permissible based on the temperature of the heating process fluid. When stopped at 408, the compressor can be re-started according to compressor restart procedures for the HVACR system, such as delays before permitting restart operations, restarting according to soft loading rules, or any other suitable control affecting the restarting of a compressor in an HVACR system.

Figure 5:
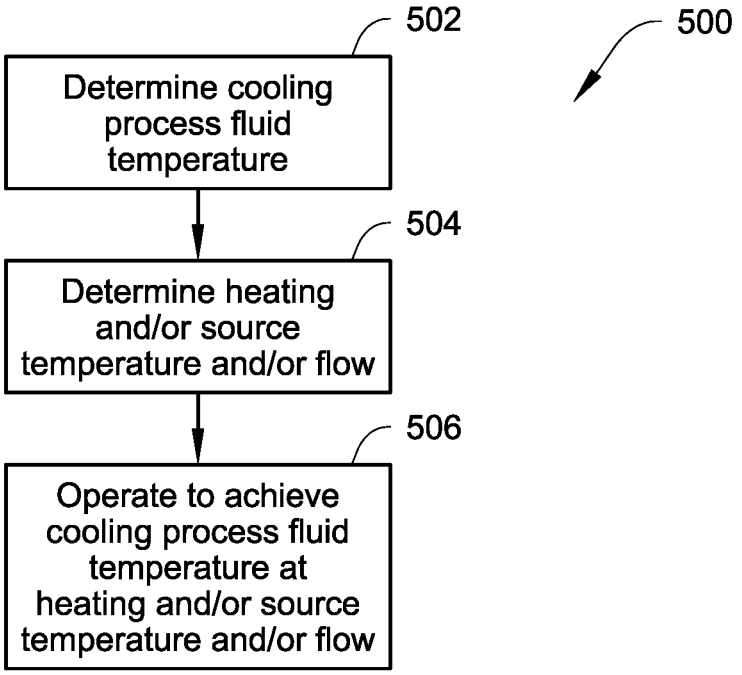
FIG. 5 shows a flowchart of a method for operating an HVACR system in a balanced cooling mode according to an embodiment.

FIG. 5 shows a flowchart of a method for operating an HVACR system in a balanced cooling mode according to an embodiment. Balanced cooling mode 500 includes determining a cooling process fluid temperature 502, determining a flow rate and/or temperature for one or both of a heating process fluid and a source fluid 504, and controlling the HVACR system 506 to provide the cooling process fluid temperature using the determined flow rate and/or temperature for the heating process fluid and/or the source fluid.

The cooling process fluid temperature can be determined at 502. The cooling process fluid temperature can be based on cooling load and/or unit or system requirements for the HVACR system. The cooling process fluid temperature can be determined according to any suitable method for setting a desired temperature for an HVACR system to meet cooling demands, such as, for example, a cooling load provided by one or more structures cooled by the HVACR system.

A flow rate and/or temperature for one or both of a heating process fluid and a source fluid is determined at 504. The flow rate and/or temperature can be determined to be flow rates and temperatures for one or both of the heating process fluid and the source fluid that allow the HVACR system to achieve the desired temperature for the cooling process fluid. The temperatures can be temperatures of the heating process fluid and/or the source fluid at the points where such temperatures are measured by temperature sensors located along the respective fluid circuits. As non-limiting examples, the temperatures can be entering or leaving temperatures at or near the inlets or outlets of a condenser and/or a heat recovery heat exchanger of the working fluid circuit. The flow rate and/or temperature can further be selected to maintain desired other operational conditions, for example to keep these other operational conditions within safe ranges. The other operational conditions can include, for example, condenser fluid temperatures, condenser refrigerant temperatures, condenser refrigerant pressures unit compressor lift, or any other suitable condition of the particular HVACR system, particularly the working fluid circuit used therein. In an embodiment, the temperature is a desired temperature for the heating process fluid, for example based on heating demand, a heating temperature set point, or the like. In an embodiment where the temperature is the desired temperature for the heating process fluid, the flow rate for the heating process fluid can be a flow rate selected to achieve the respective desired temperatures for both the cooling process fluid and the heating process fluid.

The HVACR system is operated to achieve the determined cooling process fluid temperature using the determined temperatures and/or flow rates for the heating process fluid and/or the source fluid at 506. The flow of heating process fluid and/or source fluid can be controlled based on the flow rates and/or temperatures determined at 504. The flow rates of the heating process fluid and/or the source fluid can be controlled using any suitable flow controls included in the respective heating process fluid circuit and the source fluid circuit. Non-limiting examples of the flow controls include variable-capacity pumps, diverting mixing valves, and control valves, such as those described above and shown in FIGS. 1 and 2. During the operation at 506, some or all of the temperatures of the cooling process fluid, the temperatures and flow rates of the heating process fluid and/or the source fluid, and the other operational conditions can be monitored and used to iteratively or continuously repeat the determination of the flow rates and/or temperatures at 504, which can then be used to update the operation of the HVACR system at 506.

In an embodiment, operation of the HVACR system in the balanced cooling mode 500 and operation of the HVACR system in the adaptive cooling mode 400 can be performed simultaneously, with both controls running concurrently to control both the compressor and flow control devices of the HVACR system by both modulating flow in the heating and/or source fluid circuits and also, when needed, stopping or unloading the compressor based on the heating process fluid temperature.

Figure 6:
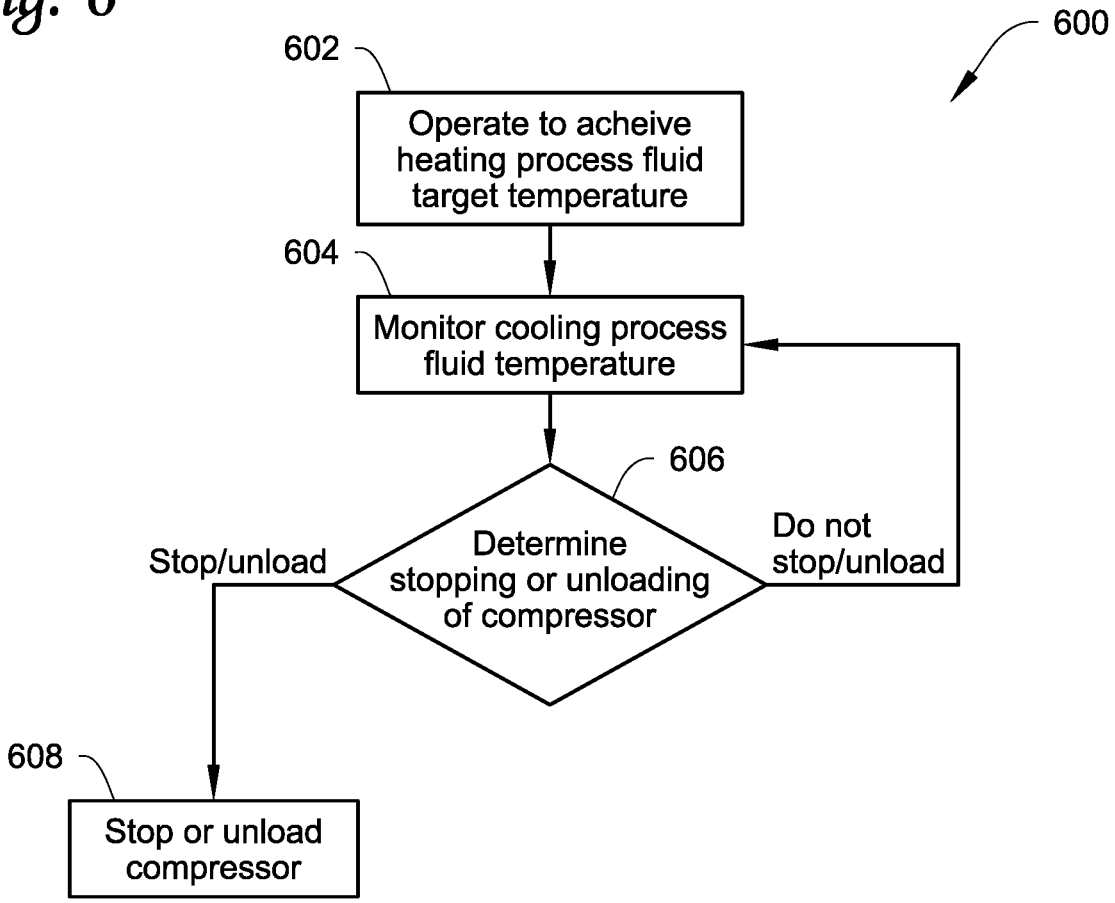
FIG. 6 shows a flowchart of a method for operating an HVACR system in an adaptive heating mode according to an embodiment.

FIG. 6 shows a flowchart of a method for operating an HVACR system in an adaptive heating mode according to an embodiment. Adaptive heating mode 600 includes controlling a temperature of the heating process fluid to achieve a target temperature 602, monitoring a cooling process fluid temperature 604, determining whether to stop or unload the compressor at 606, and stopping or unloading the compressor 608.

The temperature of the heating process fluid is controlled to achieve a target temperature at 602. The temperature of the heating process fluid can be controlled by controlling the operation of a working fluid circuit used to heat the heating process fluid, for example by controlling the operation of a compressor included in the working fluid circuit in a manner that will bring the heating process fluid temperature towards the target temperature. For example, the capacity of the compressor can be increased when the working fluid is below the target temperature. The target temperature can be a set point for the heating process fluid. The target temperature can be based on where the temperature of the heating set point is measured by a temperature sensor, for example to control according to a desired temperature for the cooling process fluid at or near an inlet or an outlet of a condenser or a heat recovery heat exchanger of the working fluid circuit where the working fluid rejects heat to the heating process fluid.

The temperature of the cooling process fluid is monitored at 604. The temperature can be monitored using one or more temperature sensors measuring the temperature of the cooling process fluid within the cooling process fluid circuit. In an embodiment, the temperature of the heating process fluid is not actively controlled during adaptive heating mode 600. In an embodiment of the adaptive heating mode 600, the temperature of the cooling process fluid can vary with the amount of heat being absorbed from the cooling process fluid at an evaporator of the working fluid circuit. The temperature sensor used to monitor the temperature of the cooling process fluid at 604 can be located anywhere along the cooling process fluid circuit. In an embodiment, multiple temperature sensors can be used to monitor the temperature of the cooling process fluid at 604. In an embodiment, one or more temperature sensors used to monitor the temperature of the cooling process fluid 604 can be located at or near an inlet or an outlet of a heat exchanger where the heating process fluid exchanges heat with the working fluid, such as the evaporator.

It is determined whether to stop or unload the compressor at 606. The determination can be made based on the temperature of the cooling process fluid monitored at 604. In an embodiment, the temperature of the cooling process fluid monitored at 604 is compared to a threshold value to determine whether to stop or unload the compressor at 606. The threshold value can be a predetermined value, for example based on the operating range of the HVAC system, such as a minimum allowed temperature for the cooling process fluid, a temperature within a safety margin of freezing temperature of the cooling process fluid, or any other suitable threshold for a minimum value of the cooling process fluid that can be used to trigger stopping or unloading of the compressor of the working fluid circuit. In an embodiment, the determination of whether to stop or unload the compressor at 606 can be based on parameters indicative of load or capacity. As a non-limiting example, flow rates for each fluid and a desired temperature differential between process fluids can be used to determine whether to stop or unload the compressor at 606. When it is determined that the compressor does not need to be stopped or unloaded at 606, for example by the temperature remaining above the threshold, the adaptive heating mode can continue by iterating until the threshold value is no longer met or exceeded or the operating mode is changed, for example by continuing the controlling of a temperature of the heating process fluid to achieve the target temperature at 602. When it is determined that the compressor is to be stopped or unloaded at 606, for example when the temperature of the cooling process fluid monitored at 604 is below the threshold value, the compressor can be stopped or unloaded at 608. The stopping or unloading of the compressor at 608 can be based on the current state of the compressor and/or the temperature of the cooling process fluid over time. The stopping or unloading of the compressor at 608 can, in one non-limiting example, include incremental unloading of the compressor, with the compressor being stopped if the cooling process fluid temperature remains too low following complete unloading of the compressor. In an embodiment, the stopping or unloading of the compressor at 608 can include stopping the compressor or selecting a level of unloading for the compressor based on a duration of time over which the heating process fluid temperature has been elevated or the extent to which the heating process fluid temperature is elevated, for example compared to the threshold value. When unloaded at 608, the compressor may have its capacity increased again subsequently, when permissible based on the temperature of the heating process fluid. When stopped at 608, the compressor can be re-started according to compressor restart procedures for the HVACR system, such as delays before permitting restart operations, restarting according to soft loading rules, or any other suitable control affecting the restarting of a compressor in an HVACR system.

Figure 7:
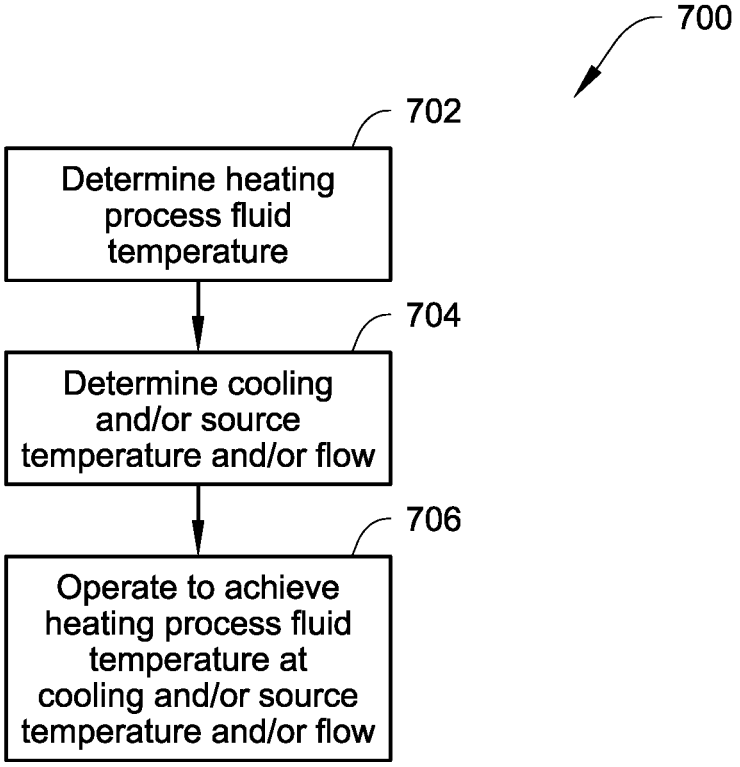
FIG. 7 shows a flowchart of a method for operating an HVACR system in a balanced heating mode according to an embodiment.

FIG. 7 shows a flowchart of a method for operating an HVACR system in a balanced heating mode according to an embodiment. Balanced heating mode 700 includes determining a heating process fluid temperature 702, determining a flow rate and/or temperature for a cooling process fluid and/or a source fluid 704, and controlling the HVACR system 706 to provide the heating process fluid temperature using the determined fluid flow rate and/or temperature for the cooling process fluid and/or the source fluid.

The heating process fluid temperature can be determined at 702. The heating process fluid temperature can be based on heating load and/or unit or system requirements for the HVACR system. The heating process fluid temperature can be determined according to any suitable method for setting a desired temperature for an HVACR system to meet heating demands, such as, for example, a heating load provided by one or more structures heated by the HVACR system. The heating demands can include, for example, needs from water heaters, terminal units used to heat spaces within a building served by the HVACR system, or any other such heating load.

A flow rate and/or temperature for one or both of a cooling process fluid and a source fluid is determined at 704. The flow rate and/or temperature can be determined to be flow rates and temperatures for one or both of the cooling process fluid and the source fluid that allow the HVACR system to achieve the desired temperature for the heating process fluid. The temperatures can be temperatures of the cooling process fluid and/or the source fluid at the points where such temperatures are measured by temperature sensors located along the respective fluid circuits. As non-limiting examples, the temperatures can be entering or leaving temperatures at or near the inlets or outlets of an evaporator and/or a heat recovery heat exchanger of the working fluid circuit. The flow rate and/or temperature can further be selected to maintain desired other operational conditions, for example to keep these other operational conditions within safe ranges. The other operational conditions can include, for example, condenser fluid temperatures, condenser refrigerant temperatures, condenser refrigerant pressures unit compressor lift, or any other suitable condition of the particular HVACR system, particularly the working fluid circuit used therein. In an embodiment, the temperature is a desired temperature for the cooling process fluid, for example based on cooling demand, a cooling temperature set point, or the like. In an embodiment where the temperature is the desired temperature for the cooling process fluid, the flow rate for the cooling process fluid can be a flow rate selected to achieve the respective desired temperatures for both the cooling process fluid and the heating process fluid.

The HVACR system is operated to achieve the determined heating process fluid temperature using the determined temperatures and/or flow rates for the cooling process fluid and/or the source fluid at 706. The flow of cooling process fluid and/or source fluid can be controlled based on the flow rates and/or temperatures determined at 704. The flow rates of the cooling process fluid and/or the source fluid can be controlled using any suitable flow controls included in the respective cooling process fluid circuit and the source fluid circuit. Non-limiting examples of the flow controls include variable-capacity pumps, diverting mixing valves, and control valves, such as those described above and shown in FIGS. 1 and 2. During the operation at 706, some or all of the temperatures of the heating process fluid, the temperatures and flow rates of the cooling process fluid and/or the source fluid, and the other operational conditions can be monitored and used to iteratively or continuously repeat the determination of the flow rates and/or temperatures at 704, which can then be used to update the operation of the HVACR system at 706.

In an embodiment, operation of the HVACR system in the balanced heating mode 600 and operation of the HVACR system in the adaptive heating mode 700 can be performed simultaneously, with both controls running concurrently to control both the compressor and flow control devices of the HVACR system.

Aspects:

It is understood that any of aspects 1-7 can be combined with any of aspects 8-12 or any of aspects 13-19. It is understood that any of aspects 8-12 can be combined with any of aspects 13-19.

Aspect 1. A heating, ventilation, air conditioning, and refrigeration (HVACR) system, comprising:

a compressor configured to compress a working fluid;

a first heat exchanger, the first heat exchanger configured to exchange heat between the working fluid and a first process fluid, wherein the first process fluid further exchanges heat with a heating load;

a second heat exchanger, the second heat exchanger configured to exchange heat between the working fluid and a second process fluid, wherein the second process fluid exchanges heat with a cooling load;

a first temperature sensor configured to measure a temperature of the first process fluid;

a second temperature sensor configured to measure a temperature of the second process fluid; and a controller, configured to selectively operate the HVACR system in a mode selected from a group including at least one of:

an adaptive cooling mode wherein the adaptive cooling mode includes controlling the HVACR system to achieve a target temperature for the second process fluid and to unload or stop the compressor when the temperature of the first process fluid exceeds a heating safety threshold value, an adaptive heating mode, wherein the adaptive heating mode includes controlling the HVACR system to achieve a target temperature for the first process fluid and to unload or stop the compressor when the temperature of the second process fluid falls below a cooling safety threshold value, a balanced cooling mode, wherein a quantity of flow of the first process fluid is controlled to meet balanced cooling target temperatures for the first process fluid and the second process fluid; and a balanced heating mode, wherein a quantity of flow of the second process fluid is controlled to meet balanced heating target temperatures for the first process fluid and the second process fluid.

Aspect 2. The HVACR system according to aspect 1, wherein the group includes the adaptive cooling mode, the adaptive heating mode, the balanced cooling mode, and the balanced heating mode.

Aspect 3. The HVACR system according to any of aspects 1-2, further comprising a third heat exchanger configured to exchange heat between the working fluid and a third process fluid, wherein the third process fluid further exchanges heat with an ambient environment.

Aspect 4. The HVACR system according to aspect 3, further comprising a pump configured to provide a variable flow of the third process fluid, wherein the balanced cooling mode further comprises modulating the variable flow of the third process fluid using the pump.

Aspect 5. The HVACR system according to any of aspects 1-4, wherein the first temperature sensor measures the temperature of the first process fluid where the first process fluid leaves the first heat exchanger and the second temperature sensor measures the temperature of the second process fluid where the second process fluid leaves the second heat exchanger.

Aspect 6. The HVACR system according to any of aspects 1-5, further comprising at least one of a pump, a control valve, and a diverting mixing valve included in a fluid circuit for the first process fluid, and wherein the controller is configured to modulate at least one of the pump, the control valve or the diverting mixing valve when in the balanced cooling mode.

Aspect 7. The HVACR system according to any of aspects 1-6, further comprising at least one of a pump, a control valve, and a diverting mixing valve included in a fluid circuit for the second process fluid, and wherein the controller is configured to modulate at least one of the pump, the control valve or the diverting mixing valve when in the balanced heating mode.

Aspect 8. A control system for a heating, ventilation, air conditioning, and refrigeration (HVACR) system comprising:

a controller configured to selectively operate the HVACR system in a mode selected from a group including at least one of:

an adaptive cooling mode wherein the adaptive cooling mode includes controlling the HVACR system to achieve a target temperature for a cooling process fluid and to unload or stop a compressor of the HVACR system when the temperature of a heating process fluid exceeds a heating safety threshold value, an adaptive heating mode, wherein the adaptive heating mode includes controlling the HVACR system to achieve a target temperature for the heating process fluid and to unload or stop the compressor when the temperature of the cooling process fluid falls below a cooling safety threshold value, a balanced cooling mode, wherein a quantity of flow of the heating process fluid is controlled to meet balanced cooling target temperatures for the heating process fluid and the cooling process fluid; and a balanced heating mode, wherein a quantity of flow of the cooling process fluid is controlled to meet balanced heating target temperatures for the heating process fluid and the cooling process fluid.

Aspect 9. The control system according to aspect 8, wherein the group includes the adaptive cooling mode, the adaptive heating mode, the balanced cooling mode, and the balanced heating mode.

Aspect 10. The control system according to any of aspects 8-9, wherein the controller is further configured to control a pump, the pump configured to provide a variable flow of a source process fluid, and at least one of the balanced cooling mode and the balanced heating mode further comprise directing the pump to modulate the variable flow of the source process fluid.

Aspect 11. The control system according to any of aspects 8-10 wherein the controller is connected to at least one of a pump, a control valve, and a diverting mixing valve included in a circuit for the heating process fluid, and is configured to modulate at least one of the pump, the control valve or the diverting mixing valve when in the balanced cooling mode.

Aspect 12. The control system according to any of aspects 8-11, wherein the controller is connected to at least one of a pump, a control valve, and a diverting mixing valve included in a circuit for the cooling process fluid, and is configured to modulate at least one of the pump, the control valve or the diverting mixing valve when in the balanced heating mode.

Aspect 13. A method of controlling a heating, ventilation, air conditioning, and refrigeration (HVACR) system, comprising:

selecting an operating mode from a group including at least one of an adaptive cooling mode, an adaptive heating mode, a balanced cooling mode, and a balanced heating mode; and operating the HVACR system according to the operating mode, wherein:

the adaptive cooling mode includes controlling the HVACR system to achieve a target temperature for a cooling process fluid and unloading or stopping a compressor when the temperature of a heating process fluid exceeds a heating safety threshold value, the adaptive heating mode includes controlling the HVACR system to achieve a target temperature for the heating process fluid and unloading or stopping the compressor when the temperature of the cooling process fluid falls below a cooling safety threshold value, the balanced cooling mode includes controlling a quantity of flow of the heating process fluid to meet balanced cooling target temperatures for the heating process fluid and the cooling process fluid; and the balanced heating mode includes controlling a quantity of flow of the cooling process fluid to meet balanced heating target temperatures for the heating process fluid and the cooling process fluid.

Aspect 14. The method according to aspect 13, wherein selecting the operating mode includes:

determining whether to prioritize cooling or heating based on cooling and heating demands, selecting one of the adaptive cooling mode or the balanced cooling mode when cooling is prioritized, and selecting one of the adaptive heating mode or the balanced heating mode when heating is prioritized.

Aspect 15. The method according to any of aspects 13-14, wherein operating the HVACR system in at least one of the balanced cooling mode or the balanced heating mode includes controlling an amount of a variable flow of a source fluid separate from the cooling process fluid and the heating process fluid.

Aspect 16. The method according to any of aspects 13-15, wherein operating the HVACR system in the balanced heating mode includes modulating at least one of a pump, a control valve, or a diverting mixing valve included in a cooling process fluid circuit.

Aspect 17. The method according to any of aspects 13-16, wherein operating the HVACR system in the balanced cooling mode includes modulating at least one of a pump, a control valve, or a diverting mixing valve included in a heating process fluid circuit.

Aspect 18. The method according to any of aspects 13-17, wherein operating the HVACR system in the balanced cooling mode further includes unloading or stopping a compressor when the temperature of a heating process fluid exceeds a heating safety threshold value.

Aspect 19. The method according to any of aspects 13-18, wherein operating the HVACR system in the balanced heating mode further includes unloading or stopping the compressor when the temperature of the cooling process fluid falls below a cooling safety threshold value.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A heating, ventilation, air conditioning, and refrigeration (HVACR) system, comprising:

a compressor configured to compress a working fluid;

a first heat exchanger, the first heat exchanger configured to exchange heat between the working fluid and a first process fluid, wherein the first process fluid further exchanges heat with a heating load;

a second heat exchanger, the second heat exchanger configured to exchange heat between the working fluid and a second process fluid, wherein the second process fluid exchanges heat with a cooling load;

a first temperature sensor configured to measure a temperature of the first process fluid;

a second temperature sensor configured to measure a temperature of the second process fluid; and a controller, configured to selectively operate the HVACR system in each of:

an adaptive cooling mode wherein the adaptive cooling mode includes controlling the HVACR system to achieve a target temperature for the second process fluid and to unload or stop the compressor when the temperature of the first process fluid exceeds a heating safety threshold value, an adaptive heating mode, wherein the adaptive heating mode includes controlling the HVACR system to achieve a target temperature for the first process fluid and to unload or stop the compressor when the temperature of the second process fluid falls below a cooling safety threshold value, a balanced cooling mode, wherein a quantity of flow of the first process fluid is controlled to meet balanced cooling target temperatures for the first process fluid and the second process fluid; and a balanced heating mode, wherein a quantity of flow of the second process fluid is controlled to meet balanced heating target temperatures for the first process fluid and the second process fluid.

2. The HVACR system of claim 1, further comprising a third heat exchanger configured to exchange heat between the working fluid and a third process fluid, wherein the third process fluid further exchanges heat with an ambient environment.

3. The HVACR system of claim 2, further comprising a pump configured to provide a variable flow of the third process fluid, wherein the balanced cooling mode further comprises modulating the variable flow of the third process fluid using the pump.

4. The HVACR system of claim 1, wherein the first temperature sensor measures the temperature of the first process fluid where the first process fluid leaves the first heat exchanger and the second temperature sensor measures the temperature of the second process fluid where the second process fluid leaves the second heat exchanger.

5. The HVACR system of claim 1, further comprising at least one of a pump, a control valve, and a diverting mixing valve included in a fluid circuit for the first process fluid, and wherein the controller is configured to modulate at least one of the pump, the control valve or the diverting mixing valve when in the balanced cooling mode.

6. The HVACR system of claim 1, further comprising at least one of a pump, a control valve, and a diverting mixing valve included in a fluid circuit for the second process fluid, and wherein the controller is configured to modulate at least one of the pump, the control valve or the diverting mixing valve when in the balanced heating mode.

7. A control system for a heating, ventilation, air conditioning, and refrigeration (HVACR) system comprising:

a controller configured to selectively operate the HVACR system in each of:

an adaptive cooling mode wherein the adaptive cooling mode includes controlling the HVACR system to achieve a target temperature for a cooling process fluid and to unload or stop a compressor of the HVACR system when the temperature of a heating process fluid exceeds a heating safety threshold value, an adaptive heating mode, wherein the adaptive heating mode includes controlling the HVACR system to achieve a target temperature for the heating process fluid and to unload or stop the compressor when the temperature of the cooling process fluid falls below a cooling safety threshold value, a balanced cooling mode, wherein a quantity of flow of the heating process fluid is controlled to meet balanced cooling target temperatures for the heating process fluid and the cooling process fluid; and a balanced heating mode, wherein a quantity of flow of the cooling process fluid is controlled to meet balanced heating target temperatures for the heating process fluid and the cooling process fluid.

8. The control system of claim 7, wherein the controller is further configured to control a pump, the pump configured to provide a variable flow of a source process fluid, and at least one of the balanced cooling mode and the balanced heating mode further comprise directing the pump to modulate the variable flow of the source process fluid.

9. The control system of claim 7, wherein the controller is connected to at least one of a pump, a control valve, and a diverting mixing valve included in a circuit for the heating process fluid, and is configured to modulate at least one of the pump, the control valve or the diverting mixing valve when in the balanced cooling mode.

10. The control system of claim 7, wherein the controller is connected to at least one of a pump, a control valve, and a diverting mixing valve included in a circuit for the cooling process fluid, and is configured to modulate at least one of the pump, the control valve or the diverting mixing valve when in the balanced heating mode.

11. A method of controlling a heating, ventilation, air conditioning, and refrigeration (HVACR) system, comprising:

selecting an operating mode from a group including an adaptive cooling mode, an adaptive heating mode, a balanced cooling mode, and a balanced heating mode; and operating the HVACR system according to the operating mode, wherein:

the HVACR system is configured to be selectively operated in each of the adaptive cooling mode, the adaptive heating mode, the balanced cooling mode, and the balanced heating mode:

the adaptive cooling mode includes controlling the HVACR system to achieve a target temperature for a cooling process fluid and unloading or stopping a compressor when the temperature of a heating process fluid exceeds a heating safety threshold value, the adaptive heating mode includes controlling the HVACR system to achieve a target temperature for the heating process fluid and unloading or stopping the compressor when the temperature of the cooling process fluid falls below a cooling safety threshold value, the balanced cooling mode includes controlling a quantity of flow of the heating process fluid to meet balanced cooling target temperatures for the heating process fluid and the cooling process fluid; and the balanced heating mode includes controlling a quantity of flow of the cooling process fluid to meet balanced heating target temperatures for the heating process fluid and the cooling process fluid.

12. The method of claim 11, wherein selecting the operating mode includes:

determining whether to prioritize cooling or heating based on cooling and heating demands, selecting one of the adaptive cooling mode or the balanced cooling mode when cooling is prioritized, and selecting one of the adaptive heating mode or the balanced heating mode when heating is prioritized.

13. The method of claim 11, wherein operating the HVACR system in at least one of the balanced cooling mode or the balanced heating mode includes controlling an amount of a variable flow of a source fluid separate from the cooling process fluid and the heating process fluid.

14. The method of claim 11, wherein operating the HVACR system in the balanced heating mode includes modulating at least one of a pump, a control valve, or a diverting mixing valve included in a cooling process fluid circuit.

15. The method of claim 11, wherein operating the HVACR system in the balanced cooling mode includes modulating at least one of a pump, a control valve, or a diverting mixing valve included in a heating process fluid circuit.

16. The method of claim 11, wherein operating the HVACR system in the balanced cooling mode further includes unloading or stopping a compressor when the temperature of a heating process fluid exceeds a heating safety threshold value.

17. The method of claim 11, wherein operating the HVACR system in the balanced heating mode further includes unloading or stopping the compressor when the temperature of the cooling process fluid falls below a cooling safety threshold value.

* * * * *